US006527586B2

(12) United States Patent
Okamura et al.

(10) Patent No.: US 6,527,586 B2
(45) **Date of Patent: *Mar. 4, 2003**

(54) WATERPROOF CONNECTOR

(75) Inventors: Kenji Okamura, Suzuka (JP); Yasuhiro Hattori, Yokkaichi (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,304

(22) PCT Filed: Jun. 7, 1999

(86) PCT No.: PCT/JP99/03036

§ 371 (c)(1),
(2), (4) Date: Feb. 8, 2000

(87) PCT Pub. No.: WO99/65120

PCT Pub. Date: Dec. 16, 1999

(65) Prior Publication Data

US 2002/0002000 A1 Jan. 3, 2002

(30) Foreign Application Priority Data

Jun. 8, 1998 (JP) ..... 10-159451

(51) Int. Cl.[7] ..... H01R 13/40
(52) U.S. Cl. ..... 439/587
(58) Field of Search ..... 439/587, 589, 439/274, 275, 279

(56) References Cited

U.S. PATENT DOCUMENTS

| | | | | | |
|---|---|---|---|---|---|
| 4,944,688 | A | | 7/1990 | Lundergan | |
| 5,613,868 | A | * | 3/1997 | Ohsumi et al. | 439/275 |
| 5,630,731 | A | * | 5/1997 | Sawada | 439/587 |
| 5,634,807 | A | | 6/1997 | Saito | |
| 5,643,018 | A | | 7/1997 | Sakai et al. | |
| 5,709,563 | A | * | 1/1998 | Saito | 439/275 |
| 5,766,038 | A | | 6/1998 | Sugie | |

FOREIGN PATENT DOCUMENTS

| | | | |
|---|---|---|---|
| EP | 0 948 090 A1 | | 10/1999 |
| EP | 0 948 092 A1 | | 10/1999 |
| JP | U-4-49478 | | 4/1992 |
| JP | A-7-240250 | | 9/1995 |
| JP | 7-240250 | * | 9/1995 |
| JP | A-7-263076 | | 10/1995 |
| JP | A-7-320811 | | 12/1995 |
| JP | A-7-326422 | | 12/1995 |
| JP | A-7964 | | 1/1996 |
| JP | A-9-139248 | | 5/1997 |
| JP | A-9-204954 | | 8/1997 |
| JP | A-10-125391 | | 5/1998 |
| WO | WO 97/36346 | | 10/1997 |

OTHER PUBLICATIONS

IBM Technical Disclosure, Lyons, vol. 1, No. 5, p. 35, Feb. 1959.*

* cited by examiner

*Primary Examiner*—Neil Abrams
(74) *Attorney, Agent, or Firm*—Oliff & Berridge, PLC

(57) ABSTRACT

Terminals connected to wires pass through insertion holes of a holder and the segment holes of a seal member, and are held in the receptors of a connector housing in a state such that the seal member is housed in a recess of a seal setting portion of the connector housing. A pressing portion of the holder containing indents compresses the seal member to thereby reduce the respective sizes of the segment holes of the seal member so as deform the segment holes to shrink in conformity with the outer shape of the inserted wires.

7 Claims, 7 Drawing Sheets

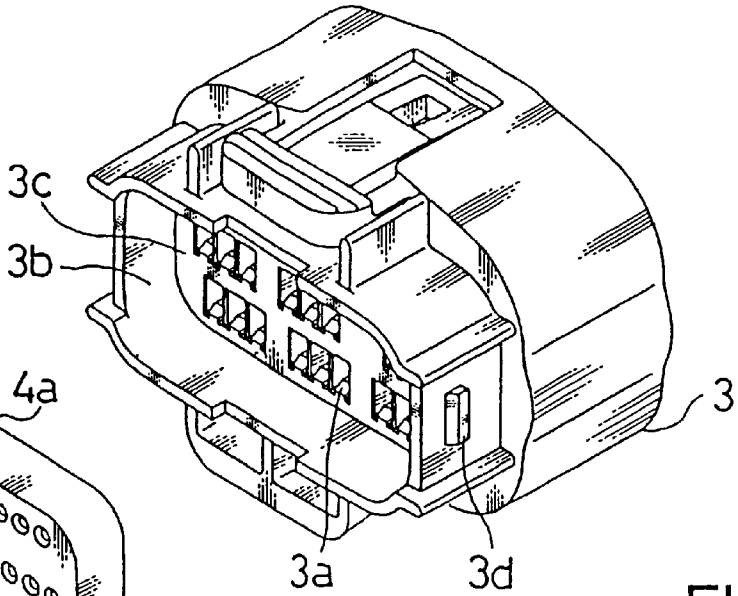
FIG.5B
PRIOR ART
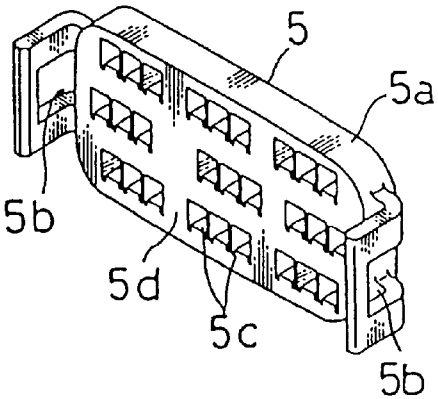
FIG.5A
PRIOR ART
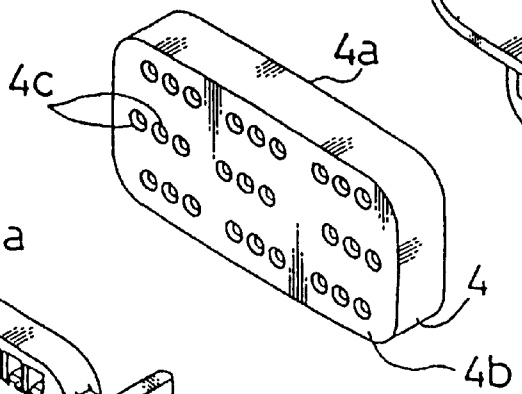
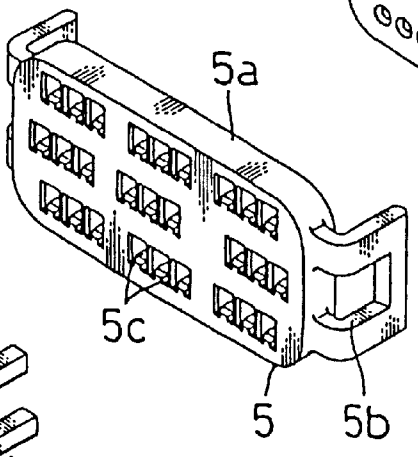
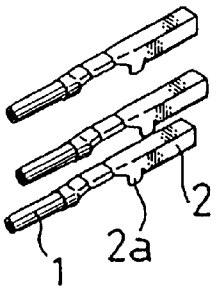

WATERPROOF CONNECTOR

BACKGROUND ART

This invention relates to a watertight connector with improved watertight performance.

As shown in FIG. 5, the applicants of the present application have proposed a watertight connector comprising: a connector housing 3 including receptors (cavities) 3*a* for inserting and holding terminals 2 fixed to wires 1 therein, and a seal setting portion 3*b* provided at a rear part of the receptors 3*a*; a resilient seal member 4 made of a soft material including a front surface 4*a* making contact with a rear surface 3*c* of the seal setting portion 3*b* of the connector housing 3, and press-fit holes 4*c* formed therein for passing the terminals and the wires for press-fitting; and a holder 5 including a holding portion 5*a* that makes contact with a rear surface 4*b* of the seal member 4 to encase the seal member 4, a pair of locking hollows 5*b* engageable with corresponding projections 3*d* on the connector housing 3 in a state that the seal member 4 is held between the connector housing 3 and the holder 5, and insertion holes Sc for inserting the terminals and the wires.

In the above watertight connector, as shown in FIG. 6A, the connector housing 3, the seal member 4, and the holder 5 are assembled one another in a state that the seal member 4 is seated in fit contact with the seal setting portion 3*b* of the connector housing 3, the holding portion 5*a* of the holder 5 encases the rear surface 4*b* of the seal member 4 in fit contact therewith, and the projections 3*d* engage with the locking hollows 5*b*.

In this state, after the terminals 2 pass through insertion holes Sc of the holder 5, as shown in FIG. 6B, the terminals 2 are press-fitted in the press-fit holes 4*c* of the seal member 4 and abutted against lance portions 3*e* while held by the receptors 3*a* of the connector housing 3. The wires 1 are press-fitted in the pressfit holes 4*c* of the seal member 4, and in this way, the outer surface of the wires 1 is sealed in a water-tight state.

Thereafter, as shown in FIG. 6C, when projections 6*a* of a retainer 6 are thrust into the receptors 3*a* from the front side of the connector housing 3, the tip ends of the projections 6*a* are abutted against the tip ends of the lance portions 3*e* to thereby hinder the retainer 6 from being further thrust any more. This is a half-fitted state where the terminals 2 are in incomplete engagement with the lance portions 3*e*. Further thrusting the terminals 2 from the rear side of the connector accomplishes a complete engagement with the lance portions 3*e*.

When the projections 6*a* of the retainer 6 are completely thrust into the receptors 3*a*, the projections 6*a* engage with the lance portions 3*e* so that the lance portions 3*e* may not be deflected. Thus, the terminals 2 are prevented from loosening off from the connector.

In the above conventional watertight connector, the terminals 2 and the wires 1 are required to be altogether press-fitted in the press-fit holes 4*c* of the seal member 4. Accordingly, it is highly likely that part of the seal member 4 around the press-fit holes 4*c* may be damaged or scraped off due to forcible insertion of the tubular terminals 2 each having a rectangular shape in cross-section into the press-fit holes 4*c* and that the scraped part may be intruded inside the terminals to thereby cause an electrical problem resulting from inferior contact of the connector.

Another problem may rise from the following construction of the above watertight connector. Each of the terminals 2 is provided with a stabilizer 2*a* projecting outward on a lateral side thereof as a mark for preventing a possibility that the terminals 2 may be inserted upside down. Since the press-fit hole 4*c* has, as shown in detail in FIG. 7A, a smaller dimension than the outer configuration of the terminal 2 viewed from the front side, it is highly likely that the edge-shaped stabilizer 2*a* may damage the press-fit hole 4*c* while the terminal 2 being pressingly inserted in the press-fit hole 4*c* to thereby impair the sealability of the watertight connector around a portion where the wires are inserted. The above problem must be considered also in the case where the press-fit holes 4*c* have a slit-like shape, as shown in FIG. 7B.

In view of the above problems residing in the prior art, it is an object of this invention to provide a watertight connector with improved watertight performance at a portion where a connector housing and wires are provided.

DISCLOSURE OF THE INVENTION

To solve the above problems, according to an aspect of this invention, this invention is directed to a watertight connector comprising: a connector housing formed with receptors for inserting and holding terminals connected to wires therein, and a seal setting portion provided at a rear part of the receptors; a resilient seal member made of a soft material including a front surface made in contact with a rear surface of the seal setting portion and formed with segment holes for inserting the terminals and the wires therein; and a holder including a pressing portion made in contact with a rear surface of the seal member to compress the seal member forward, a locking part engageable with the connector housing when the seal member is compressed, and insertion holes for inserting the terminals and the wires therein. The watertight connector has the features that the seal setting portion of the connector housing is formed with a housing recess for housing the seal member therein, and that the seal member is compressed by the pressing portion of the holder when the seal member is housed in the housing recess in a state that the terminals connected to the wires pass through the insertion holes of the holder and the segment holes of the seal member and are held in the receptors of the connector housing.

According to this invention, the seal member is housed in the housing recess of the seal setting portion of the connector housing, and the terminals connected to the wires pass through the insertion holes of the holder and the segment holes of the seal member and are held in the receptors of the connector housing, whereby the seal member is compressed by the pressing portion of the holder. Consequently, the segment holes of the seal member reduce the respective sizes thereof due to the compression so as to deform in conformity with the outer shape of the wires.

In this way, when the seal member is housed in the housing recess defined in the seal setting portion of the connector housing and compressed by the pressing portion of the holder, the front surface of the seal member makes fit contact with the rear surface of the seal setting portion, and the outer surface of the seal setting portion makes fit contact with the inner surface of the housing recess. Thus, the sealable contact area of the seal member with the connector housing increases to secure sealability of the connector at the connector housing portion.

Further, as the compression of the seal member reduces the sizes of the segment holes, the seal member is deformed into such a shape as to follow the outer shape of the wires. Thus, secured is the sealability of the connector at a portion where the wires are inserted.

There is an idea of forming a housing recess in a front surface of a pressing portion of a holder in place of forming the housing recess in the seal setting portion of the connector housing. In this case, the seal member is set in the housing recess of the holder. This arrangement may cause a problem that the sealable contact area of the seal member with the connector housing decreases because the contact of the seal member with the connector housing is limited to the contact of the front surface of the seal member with the rear surface of the seal setting portion of the connector housing without a fit contact of the outer surface of the seal member with the connector housing. This arrangement is liable to result in an insecure sealed state of the connector at the connector housing portion.

In order to prevent the above-stated problem, there is an idea of increasing the front area of the seal member. This, however, would enlarge the outer configuration of the seal member and undesirably result in large-sized holder and connector housing.

Also, the above idea of forming the housing recess in the holder results in that the seal member is set on the side of the holder when the connector is assembled. When the terminals connected to the wires pass through the insertion holes of the holder and the segment holes of the seal member and are held in the receptors of the connector housing, this arrangement may cause the following problem. Specifically, when attempting to insert the terminals connected to the wires in the segment holes of the seal member with this arrangement, the terminals may deform the seal member toward the connector housing where the seal setting portion is provided if there should remain a clearance between the front surface of the seal member and the rear surface of the connector housing where the seal setting portion is provided, thereby making the insertion operation difficult and causing an insecure sealed state of the connector where the wires are inserted.

According to another aspect of this invention, each of the segment holes of the seal member may have such a size as to make free from intervening of the insertion of the terminals. With this arrangement, there is no possibility of forcibly widening the segment holes when the terminals are inserted in the segment holes of the seal member. The resistance exerted to the seal member and the wires at the time of insertion reduces, thereby lowering a possibility of bending the terminals during the insertion operation and accordingly improving the insertion operability. Particularly, a watertight connector provided with multipoles is constructed such that signal circuits occupy primary part of the connector due to its characteristic that the connector is used as a part of an electronic unit. Accordingly, this arrangement is effective in preventing lowering insertion operability of the connector of multipolar type.

Also, there is no possibility that stabilizers of the terminals would scrape off or impair part of the seal member around the segment holes when the terminals. are inserted in the segment holes of the seal member. Accordingly, prevented is deterioration of sealability of the connector at a portion where the wires are inserted, and watertight performance thereof is improved.

According to still another aspect of this invention, preferably, each of the segment holes of the seal member may have such a size as to enable insertion of a plurality of terminals side by side in a row. With this arrangement, there is no need of molding a partition wall with a very small thickness in the seal member due to a small interval between the adjacent insertion holes of the seal member. Thereby, molding of the segment holes in the seal member is facilitated.

According to yet another aspect of this invention, the insertion holes of the holder may be so formed as to correspond to the receptors of the connector housing. Provided that the dimension of the insertion holes of the holder should be set so large as to enable insertion of the plurality of terminals side by side in correspondence with the size of the segment holes of the seal member in addition to the structure that each of the segment holes of the seal member is so formed as to enable insertion of the plurality of terminals side by side in a row, such an arrangement would undesirably allow the seal member to deform into the shape of the large insertion holes of the holder when being compressed, thereby hindering effective compression of the seal member. Further, such an arrangement would make it impossible to accurately hold the position of the receptors of the connector housing at the time of terminal insertion and thus make it impossible to accurately insert the terminals in the receptors of the connector housing through the insertion holes of the holder and the segment holes of the seal member. The preferred arrangement, however, would eliminate such a problem.

According to still further aspect of this invention, preferably, a front surface of the holder may be formed, at positions corresponding to the segment holes, with indents to receive a part of the press-deformed seal member when the holder is engaged with the connector housing. With this arrangement, as the part of the seal member is intruded in the indents when the seal member is compressed, the segment holes of the seal member are further deformed in conformity with the outer shape of the wires, thereby furthermore enhancing watertight effect of the connector where the wires are provided.

BRIEF DESCRIPION OF THE DRAWINGS

Figure 3A:
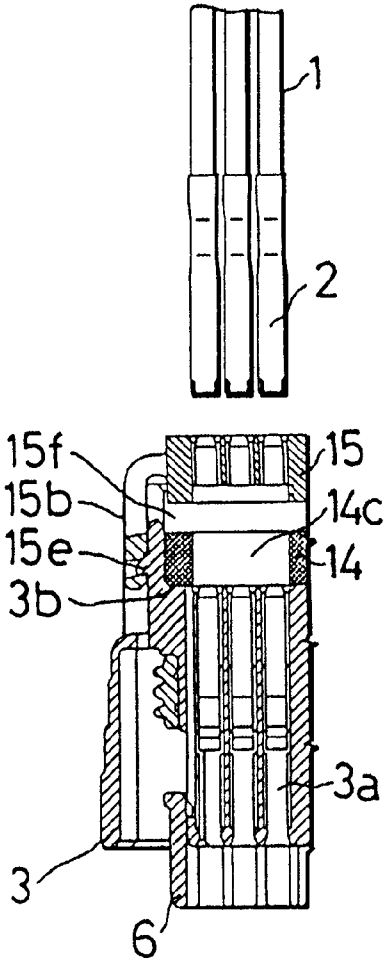
Figure 3B:
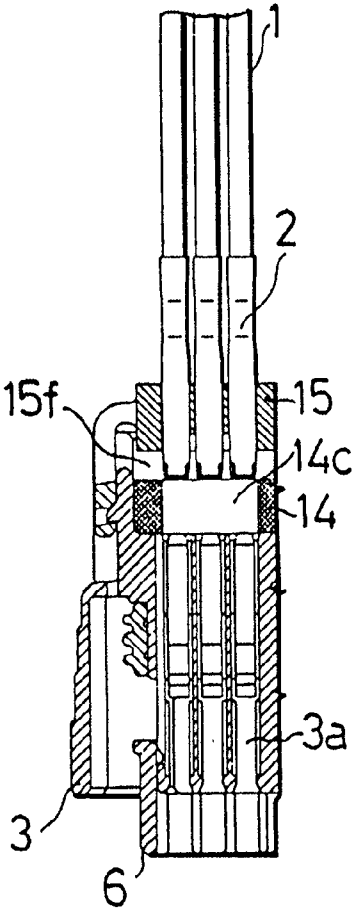
Figure 3C:
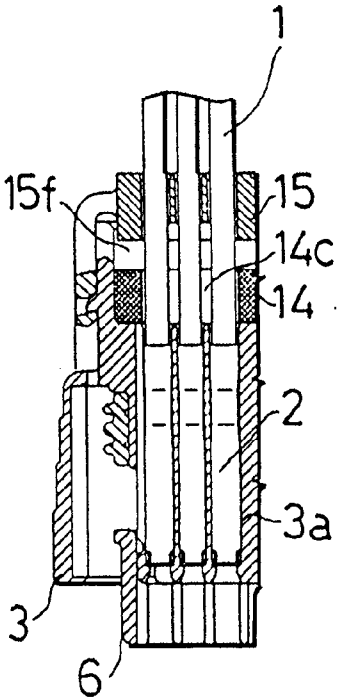
Figure 3D:
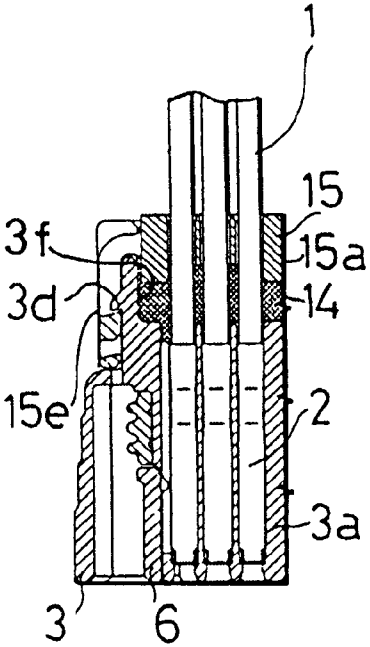
Figure 4A:
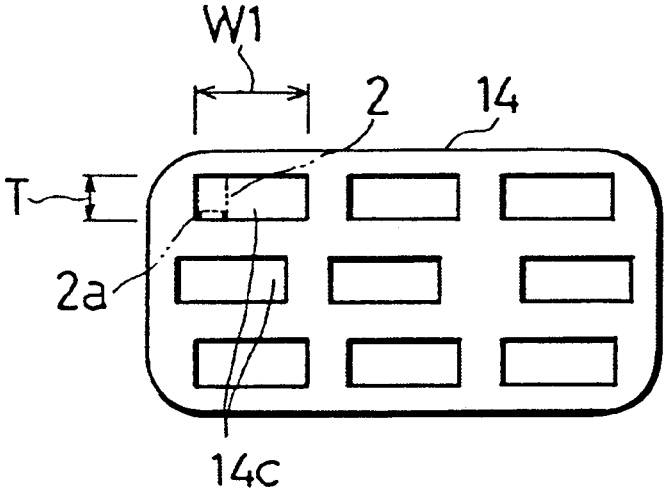
Figure 4B:
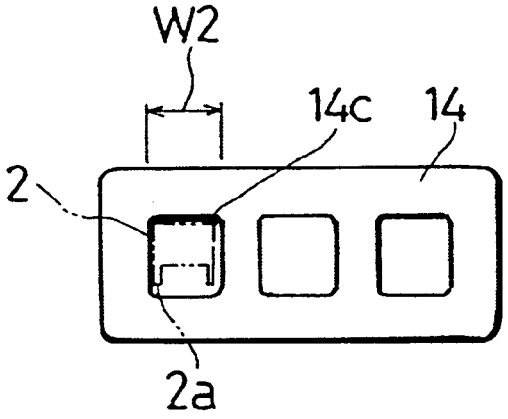
Figure 6A:
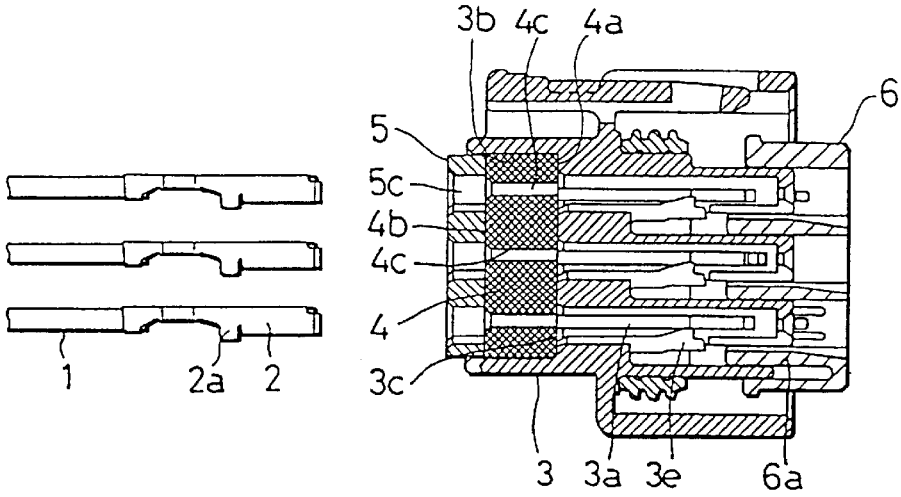
FIG.6A PRIOR ART
Figure 6B:
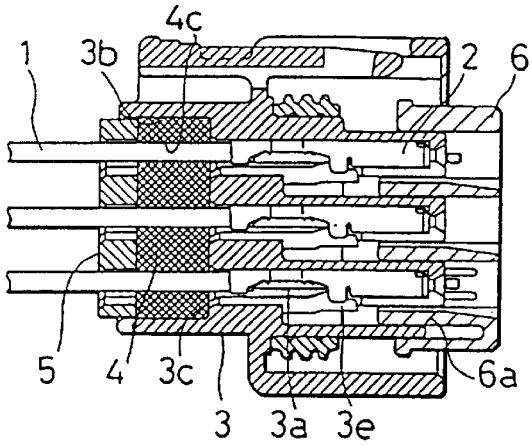
FIG.6B PRIOR ART
Figure 6C:
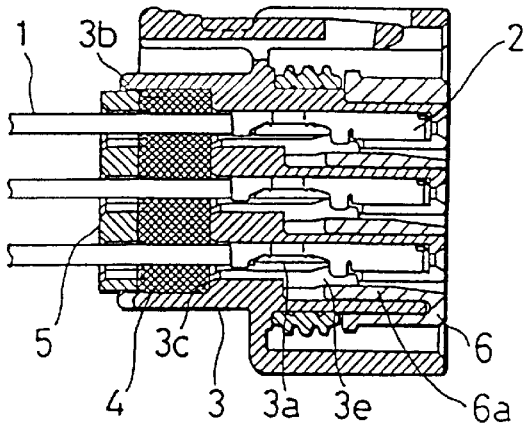
FIG.6C PRIOR ART
Figure 7A:
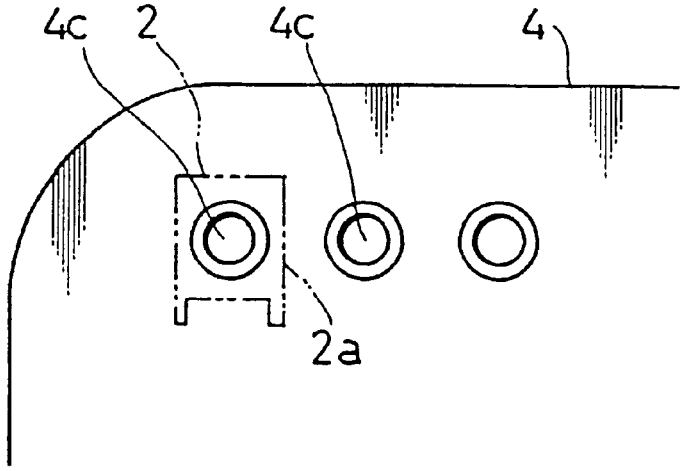
FIG.7A PRIOR ART
Figure 7B:
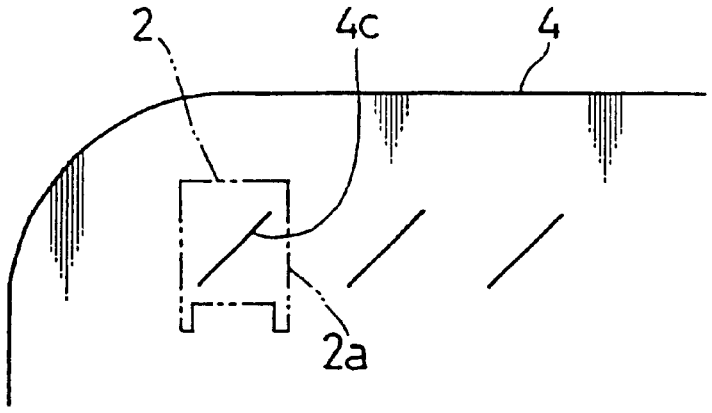
FIG.7B PRIOR ART

FIGS. 3A to 3D are diagrams illustrating a sequence of assembling the watertight connector, FIG. 3A being a plan view in section before the terminal is inserted, FIG. B being a side view in section showing a state that the terminal is on the way of insertion, FIG. 3C being a plan view in section showing a state that the terminal is engaged, and FIG. 3D being a plan view in section showing a state that the retainer is thrust;

FIGS. 4A and 4B are front views respectively showing a seal member of the watertight connector and an altered form thereof;

FIGS. 5A and 5B are diagrams of a watertight connector of prior art, FIG. 5A being an exploded perspective view, and FIG. 5B being a perspective view showing a frontnart of a holder of the conventional watertight connector;

FIGS. 6A to 6C are side views in section showing a sequence of assembling the conventional watertight connector, FIG. 6A showing a state before a terminal is inserted, FIG. 6B showing a state that the terminal is engaged, and FIG. 6C showing a state that a retainer is thrust; and FIGS. 7A and 7B are front views each illustrating essential parts of a seal member of the conventional watertight connector.

BEST MODE FOR CARRYING OUT THE INVENTION

As shown in FIG. 1, a watertight connector according to this invention comprises a connector housing 3 made of a synthetic resin. The connector housing 3 includes receptors (cavities) 3*a* for inserting and holding terminals 2 fixed to wires 1 and a seal setting portion 3*b* provided at a rear part of the receptors 3*a*.

The seal setting portion 3*b* is formed with a hood portion protruding rearward from a rear part of the connector housing 3 to form a housing recess 3*f* defined by the hood portion in which a resilient seal member 14 made of a soft material is housed.

The seal member 14 is, for example, made of a styrene thermoplastic elastomer or urethane gel or silicone gel, and is formed with insertion segment holes 14*c* (through holes) extending in rearward and forward directions of the connector for inserting the terminals and the wires. As depicted in detail in FIG. 4A, each segment hole 14*c* has a width W1 capable of inserting a group of terminals 2, for instance, three terminals, side by side in a row.

Each segment hole 14*c* has a height T capable of inserting a group of terminals 2 altogether with stabilizers (projections) 2*a*. As shown in FIG. 4B, each segment hole 14*c* may have a width W2 capable of inserting a single terminal 2.

When the seal member 14 is housed in the housing recess 3*f* of the connector housing 3, a front surface 14*a* of the seal member 14 is made in fit contact with a rear surface 3*c* of the seal setting portion 3*b*, while an outer surface 14*d* of the seal member 14 is made in fit contact with an inner surface 3*g* of the housing recess 3*f*.

It is possible to mold the connector housing 3 made of a synthetic resin and the resilient seal member 14 made of a soft material into a single molded member made of multiple layers. Also, it is possible to mold the connector housing 3 and the seal member 14 in a state that one of the two members is inserted in the other. In both cases, an operation to set the seal member 14 in the connector housing 3 at the time of assembling the connector can be omitted.

The (sic) holder 15 includes a pressing portion 15*a* made in contact with the rear surface 14*b* of the seal member 14 to compress the seal member 14 forward. The holder 15 is formed, at opposite ends of the pressing portion 5*a*, locking hollows 15*b* engageable with locking projections 3*d* of the connector housing 3 in a compressed state of the seal member 14, and sub locking hollows 15*e* that are temporarily engaged with the locking projections 3*d* in a non-compressed state of the seal member 14.

The pressing portion 15*a* is formed with a certain number of insertion holes (through holes) 15*c* corresponding to the receptors 3*b* of the connector housing 3. Each insertion hole 15*c* extends in forward and rearward directions of the connector to insert the terminal and the wire.

Figures 1A, 1B:
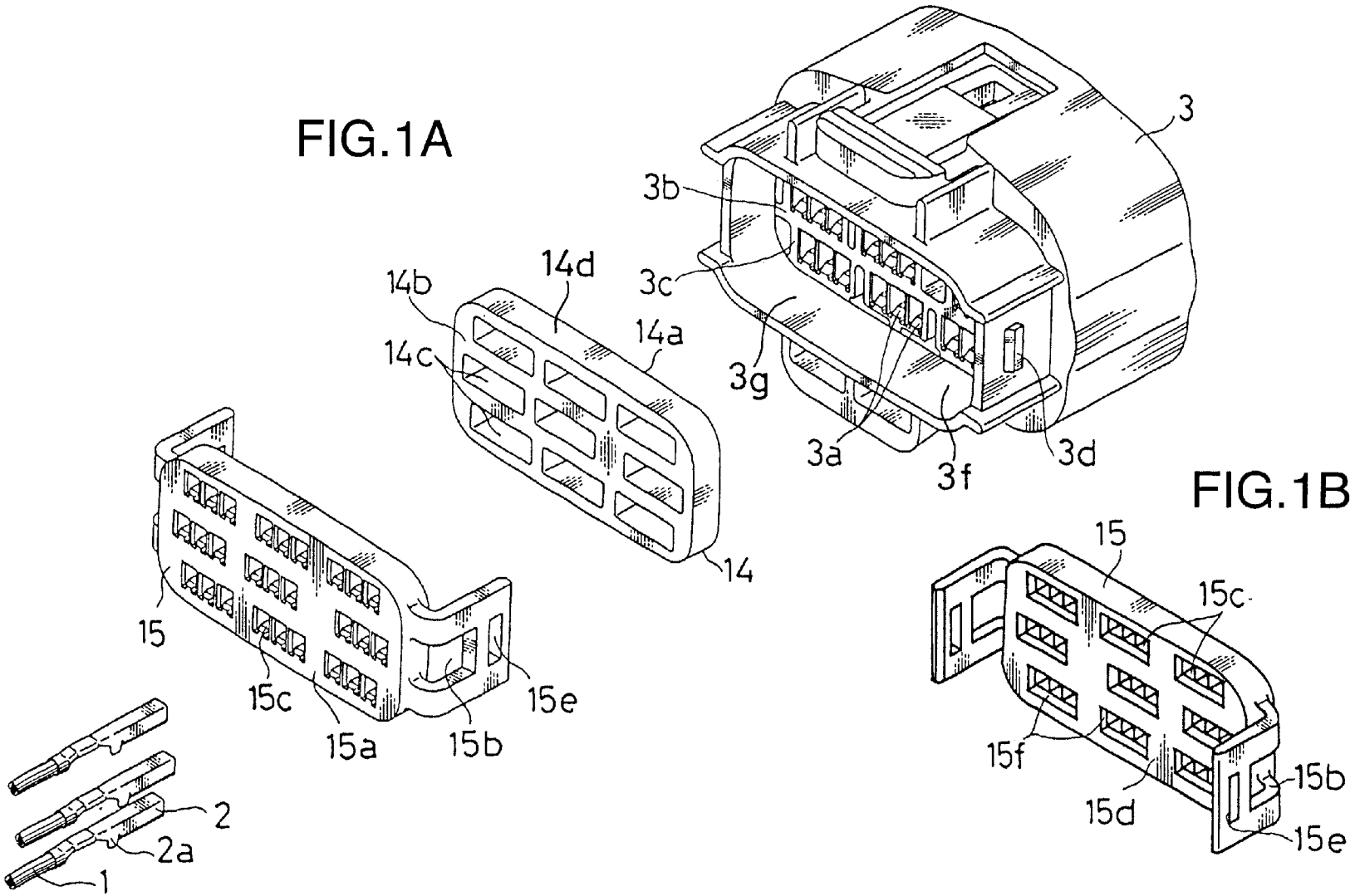
FIG. 1A is an exploded perspective view of a watertight connector according to this invention.
FIG. 1B is a perspective view of a front part of a holder of the watertight connector.

A front surface (compressing surface) 15*d* of the pressing portion 15*a* is, as shown in detail in FIG. 1B, formed with indents 15*f* for accommodating part of the seal member 14 in a compressed and deformed state in correspondence with the segment holes 14*c* of the seal member 14 when the holder 15 is engaged with the connector housing 3.

Figure 2A:
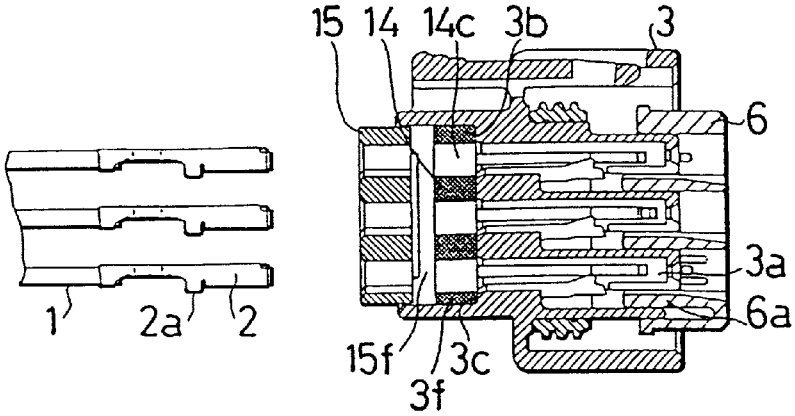
FIGS. 2A to 2D are side views in section illustrating a sequence of assembling the watertight connector, FIG. 2A showing a state before a termiinal is inserted, FIG. 2B showing a state that the terminal is on the way of insertion, FIG. 2C showing a state that the terminal is engaged, and FIG. 2D showing a state that a retainer is thrust.

In the above arrangement, when the connector housing 3, the seal member 14, and the holder 15 are assembled together, as shown in FIGS. 2A and 3A, the seal member 14 is housed in the housing recess 3*f* of the connector housing 3 with the seal member 14 seated on the seal setting portion 3*b*. Then, the locking projections 3*d* of the connector housing 3 are engaged with the sub locking hollows 15*e* of the holder 15. At this time, the seal member 14 is not compressed by the pressing portion 15*a* of the holder 15.

Figure 2B:
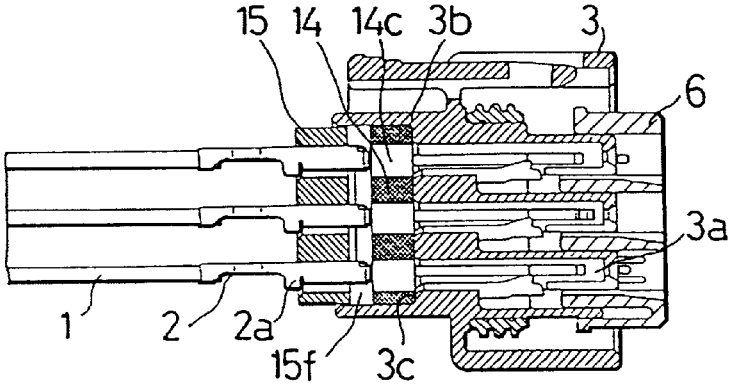
Figure 2C:
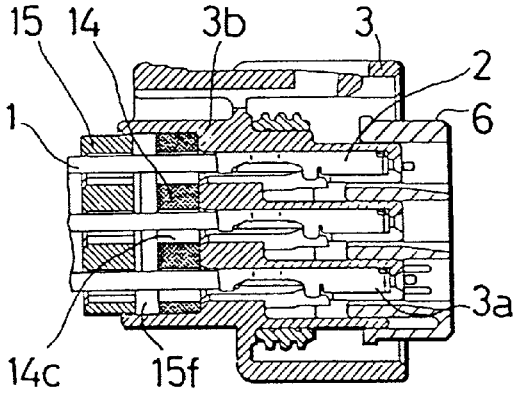

In this state, as shown in FIGS. 2B and 3B, after being inserted in the insertion holes 15*c* of the holder 15, the terminals 2 are easily provided in the segment holes 14*c* of the seal member 14, and then engaged with lance portions 3*e* while fittingly held by the receptors 3*a* of the connector housing 3.

Figure 2D:
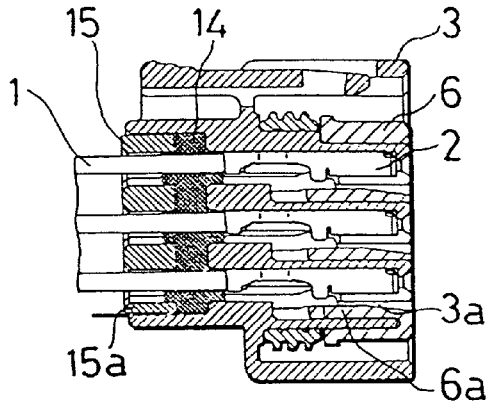

Thereafter, as shown in FIGS. 2D and 3D, pushing the holder 15 forward with the front surface 15*d* of the pressing portion 15*a* made in contact with the rear surface 4*b* of the seal member 14 to engage the locking projections 3*d* with the locking hollows 15*b* enables to compress the seal member 14 forward against the pressing portion 15*a*.

Accompanied by the compression, the segment holes 14*c* are inwardly compressed to thereby reduce their sizes thereof (compressed deformation) in conformity with the outer shape of the inserted wires 1. In this way, the outer circumferences of the wires 1 are sealed in a water-tight state.

Simultaneously, part of the seal member 14 compressed during the engagement of the holder 15 with the connector housing 3 is intruded in the indents 15*f* of the front surface 15*d* of the holder 15 to thereby cause further deformation of the segment holes 14*c* in conformity with the outer shape of the wires 1.

Subsequently, when projections 6*a* of a retainer 6 are thrust in the receptors 3*a* from the front side of the connector housing 3, the tip ends of the projections 6*a* abut against the tip ends of the lance portions 3*e* to thereby hinder the retainer 6 from being further thrust any more. This is a half-fitted state where the terminals 2 are in incomplete engagement with the lance portions 3*e*. Further pushing the terminals 2 from the rear side of the connector accomplishes a complete engagement with the lance portions 3*e*.

When the projections 6*a* of the retainer 6 are completely thrust into the receptors 3*a*, the projections 6*a* engage with the lance portions 3*e* so that the lance portions 3*e* may not be deflected. Thus, the terminals 2 are prevented from loosening off from the connector.

In the watertight connector having the above construction, the terminals 2 are inserted in the segment holes 14*c* through the insertion holes 15*c* in a state that the holder 15 is temporarily engaged with the connector housing 3, and then held by the receptors 3*a* of the connector housing 3.

Thereafter, locking the holder 15 to the connector housing 3 compresses and deforms the seal member 14 by the pressing portion 15*a* of the holder 15 such that the segment holes 14*c* reduce the size thereof and deform in conformity with the outer shape of the wires 1.

When the terminals 2 pass through the segment holes 14*c*, the seal member 14 is not yet compressed, and accordingly, the dimension of each segment hole 14*c* is substantially the same as the outer configuration of the group of terminals 2 viewed from the front side of the connector. Accordingly, there is no need of forcibly widening the segment holes 14*c* with insertion of the terminals 2, and a resistance exerted to the seal member 14 and the wires 1 during the insertion of the terminals 2 is reduced. Thus, the wires 1 hardly bend, and insertion operability of the wires 1 is improved.

Particularly, the watertight connector provided with multipoles (for example, 27 poles) as shown in the embodiment is highly popular as a part of an electronic unit, and it is often the case that thin wires 1 which are liable to bend are provided due to the characteristic of the electronic unit that signal circuits occupy primary part of the unit. Accordingly, the above arrangement of the watertight connector is advantageous in preventing lowering of insertion operability of the wires.

The above arrangement is effective because of no possibility of scraping off or damaging part of the seal member 14 around the segment holes 14*c* due to forcible insertion of the terminals 2. Thus, this arrangement is free from a problem of lowering sealability of the connector, and watertight effect of the part of the connector where the wires are inserted enhances.

The terminals 2 and wires 1 altogether pass through the segment holes 14*c* of the seal member 14 without compression of the seal member 14 in a temporarily engaged state of the holder 15 with the connector housing 3. Since the segment holes 14*c* of the seal member 14 are not yet subject to compressive deformation at this stage, the terminals 2 and wires 1 can be smoothly inserted in the segment holes 14*c*, thereby facilitating assembling operation of the connector.

Also, each of the segment holes 14*c* of the seal member 14 has such a size as to enable insertion of a group of terminals 2 side by side in a row. This arrangement eliminates molding of a partition wall of a very small thickness in the seal member 14 due to a small interval between the adjacent insertion holes 14*c* as having been formed in the conventional watertight connector, and accordingly facilitates molding of the segment holes 14*c*.

The insertion holes 15*c* of the holder 15 are so formed as to correspond to the receptors 3*a* of the connector housing 3.

Provided that the insertion holes 15*c* of the holder 15 should have the same dimension as the segment holes 14*c* of the seal member 14, the seal member 14 would easily deform into the large space configuration of the insertion holes 15*c* at the time of compression, thereby obstructing an effective deformation of the seal member 14. The above arrangement of this embodiment eliminates such a problem that would make it impossible to accurately hold the position of the receptors 3*a* of the connector housing 3 at the time of terminal insertion and would make it impossible to accurately insert the terminals in the receptors 3*a* of the connector housing 3 through the insertion holes 15*c* of the holder 15 and the segment holes 14*c* of the seal member 14.

Further, since the indents 15*f* are formed in the front surface 15*d* of the pressing portion 15*a* of the holder 15 in correspondence with the segment holes 14*c*, part of the seal member 14 is intruded in the indents 15*f* in the compression of the seal member 14, and accordingly, the seal member 14 is subject to further compressive deformation following the outer shape of the wires 1, thus further enhancing watertigh effect fthe connector where the wires are inserted.

EXPLOITATION IN INDUSTRY

The watertight connector according to this invention provides improved watertight performance on the part of the connector where the connector housing and the wires are provided.

We claim:

1. A watertight connector comprising:

a connector housing formed with a plurality of receptors, each receptor adapted for receiving and holding a terminal connected with a wire, the terminal having a first size, and the connector housing being formed with an engaging part;

a holder having a plurality of holes, each hole having a second size larger than the first size of the terminal allowing smooth passage of a single terminal therethrough, the holder being formed with an engaging part engageable with the engaging part of the connector housing, the engagement of the holder and the connector housing providing a first relative position of the holder with respect to the connector housing to make a first space between the connector and the holder and a second relative position of the holder with respect to the connector housing to make a second space between the connector and the holder, the second space being smaller than the first space; and a resilient seal member placed in a space between the connector housing and the holder, the resilient seal member having a plurality of holes, each hole having a third size larger than the first size of the terminal allowing smooth passage of a plurality of wire-connected terminals therethrough when the holder is in the first relative position, each hole having a fourth size smaller than the third size, when the seal is compressed, so that the plurality of holes of the resilient seal member come into watertight contact with an outer surface of each wire, each wire corresponding to one of the terminals, when the holder is in the second relative position, wherein the insertion holes of the holder are so formed as to correspond on a one to one relationship with the receptors of the connector housing.

2. The watertight connector according to claim 1, wherein a front surface of the holder, at positions corresponding to the segment holes, is formed with indents to receive a part of the press-deformled seal member when the holder is engaged with the connector housing.

3. The watertight connector according to claim 1, wherein the holder includes a pressing portion made in contact with a rear surface of the seal member to compress the seal member forward, a locking part engageable with the connector housing when the seal member is compressed, and insertion holes for inserting the terminals and the wires therein, a front surface of the holder, at a position corresponding to the segment holes, having indents to receive a part of the seal member that is press-deformed when the holder is engaged with the connector housing, wherein the seal setting portion of the connector housing is formed with a housing recess for housing the seal member therein, and the seal member is compressed by the pressing portion of the holder when the seal member is housed in the housing recess in a state that the terminals connected to the wires pass through the insertion holes of the holder and the segment holes of the seal member and are held in the receptors of the connector housing.

4. The watertight connector according to claim 1, wherein a front surface of the holder, at positions corresponding to the segment holes, has indents enabling the seal member to deform in such a way that the seal member deforms in conformity with the outer shape of the wires when the seal member is compressed by the holder and the connector housing.

5. The watertight connector according to claim 1, wherein the:

holder includes a pressing portion made in contact with a rear surface of the seal member to compress the seal member forward, a locking part engageable with the connector housing when the seal member is compressed, and insertion holes for inserting the terminals and the wires therein, a front surface of the holder at a position corresponding to the segment holes, having indents to receive a part of the seal member that is press-deformed when the holder is engaged with the connector housing, wherein the seal setting portion of the connector housing is formed with a housing recess for housing the seal member therein, and the seal member is compressed by the pressing portion of the holder when the seal member is housed in the housing recess in a state that the terminals connected to the wires pass through the insertion holes of the holder and the segment holes of the seal member and are held in the receptors of the connector housing.

6. A watertight connector according to claim 1, wherein the engaging part of the connector housing includes a projection provided on an outside surface of the connector housing, and the engaging part of the holder includes a sub-locking hollow engageable with the projection for providing the first relative position, and a locking hollow engageable with the projection for providing the second relative position.

7. A watertight connector according to claim 1, wherein the plurality of terminals to be inserted in each hole of the resilient seal member is arranged side by side in a row.

* * * * *